United States Patent [19]

Doty

[11] 3,966,130

[45] June 29, 1976

[54] FRAME FOR CONE CRUSHER

[75] Inventor: Floyd F. Doty, Marion, Iowa

[73] Assignee: Iowa Manufacturing Company of Cedar Rapids, Iowa, Cedar Rapids, Iowa

[22] Filed: June 9, 1975

[21] Appl. No.: 585,120

[52] U.S. Cl. ..... 241/285 R

[51] Int. Cl.[2] ..... B02C 2/00

[58] Field of Search ..... 241/207–216, 241/285 R

[56] References Cited

UNITED STATES PATENTS

| | | | |
|---|---|---|---|
| 2,860,837 | 11/1958 | Werner | 241/285 R |
| 3,150,839 | 9/1964 | Motz | 241/285 R |
| 3,302,896 | 2/1967 | Balmer et al. | 241/285 R |
| 3,774,858 | 11/1973 | Archer et al. | 241/285 R |
| 3,843,068 | 10/1974 | Allen et al. | 241/285 R |

*Primary Examiner*—Granville Y. Custer, Jr.
*Assistant Examiner*—Howard N. Goldberg
*Attorney, Agent, or Firm*—Haven E. Simmons; James C. Nemmers

[57] ABSTRACT

A composite frame for a cone crusher and the like is fabricated from a number of separate frame members which are cut or rolled from plate material and secured by welds. A particular feature of the frame is the manner of connecting the crusher main shaft housing to the outer bowl supporting structure.

5 Claims, 3 Drawing Figures

FIG 1
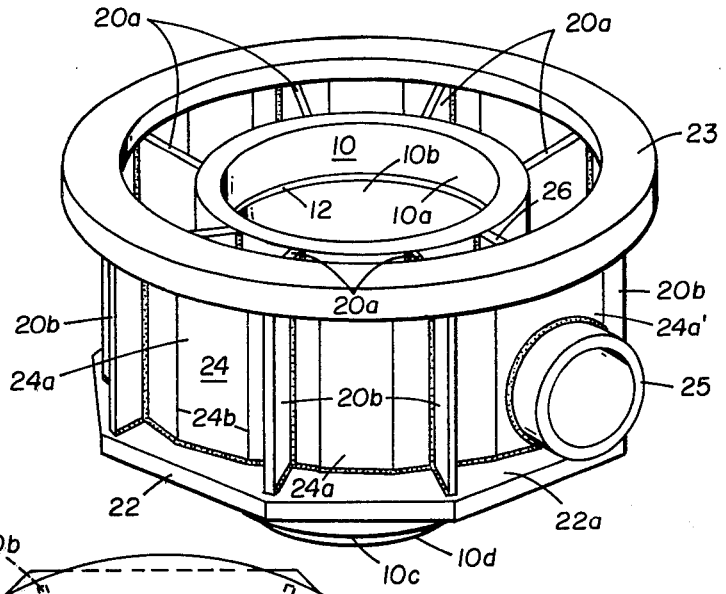
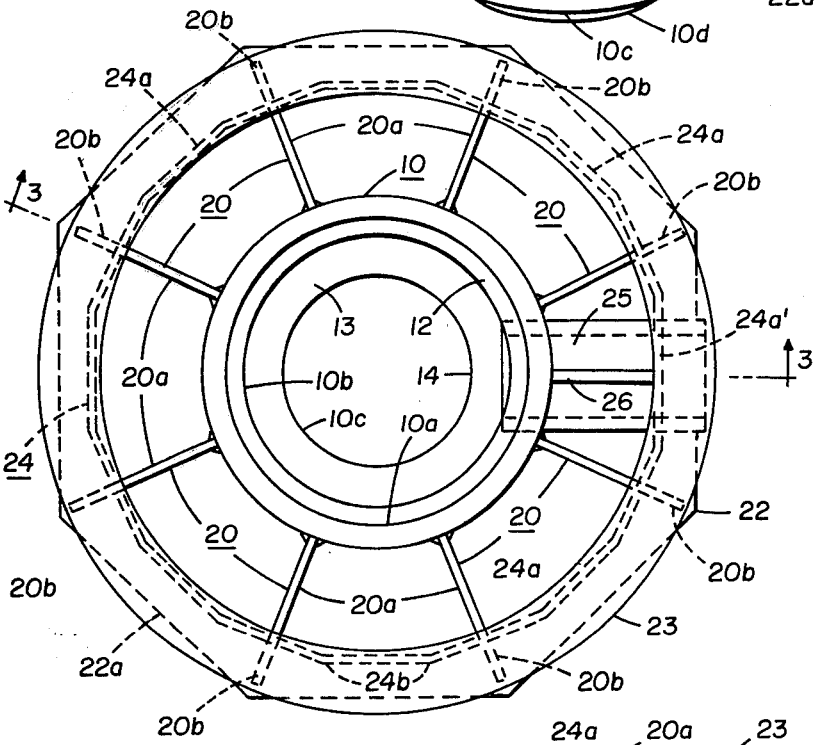
FIG 2
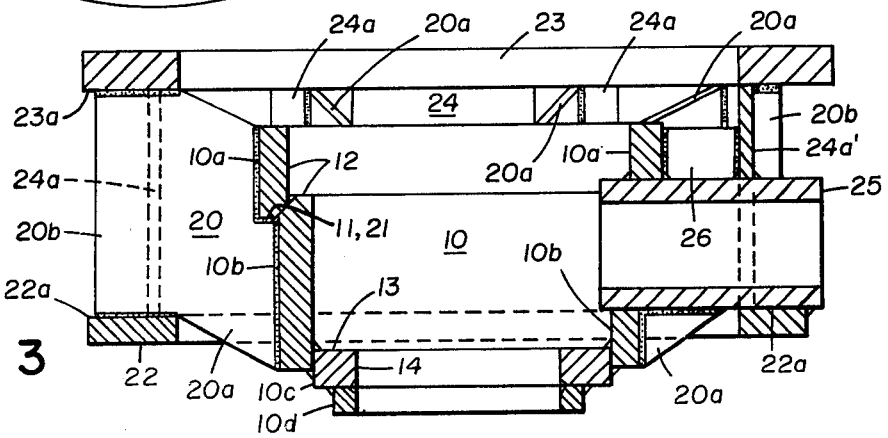
FIG 3

FRAME FOR CONE CRUSHER

BACKGROUND OF THE INVENTION

Fabricated crusher frames, as opposed to monolithic cast frames, are not in and of themselves novel. Examples of essentially fabricated frames are found in U.S. Pat. Nos. 2,155,393; 2,860,837; 3,150,839; and 3,843,068. One of their chief advantages is that to some extent they avoid the expense of patterns and molds inherent in cast frames and thereby make changes in size and design much easier to accomplish. But even the fabricated frames in the foregoing patents, while easier and cheaper to manufacture than the heavy, unwieldy and costly cast frames, are more elaborate and more difficult to manufacture than they should be. Those for cone crushers also suffer from certain breakage owing to weaknesses inherent in some aspects of their design. The primary object of the present invention, therefore, is a cone crusher frame welded up from a relatively small number of readily formed parts, in relatively few steps using simple fixtures, yet possessing great strength and rigidity.

SUMMARY OF THE INVENTION

Essentially, the frame of the present invention is built around a cylindrical inner housing for the crusher main shaft which is welded up from several rolled tubular members from whose periphery radially disposed rib plates extend outwardly to and between a pair of lower and upper base and bowl support flanges. Between the latter flanges and the rib plates are welded filler plates in order to form a polygonal shaped outer housing enclosing the frame. A drive shaft housing extends radially through the outer housing and into the inner housing.

A number of advantages accrue from the foregoing. In the first place, only the relatively small inner housing for the crusher main shaft is formed by rolling, the outer housing being built up from individual filler plates. This is in contrast to typical fabricated cone crusher frames in which the large outer housing which supports the crusher bowl is cast or rolled (see U.S. Pat. Nos. 2,860,837; 3,150,839 and 3,843,068, for instance), while the smaller main shaft housing is cast as in the first two of these patents. In the second place, the inner ends of the rib plates and the periphery of the inner main shaft housing are provided with complementary shoulders in order to relieve the welds joining the rib plates to the inner housing of many of the shear stresses that would otherwise be present. In the third place, and perhaps most important of all, the outer ends of the rib plates are carried outwardly beyond the filler plates forming the outer housing, the top and bottom edges of the rib plates being welded to the opposed faces of the upper bowl support flange and the lower base flange. Hence most of the crushing stresses from the bowl support flange are transmitted directly through the rib plates to the base flange rather than through welds alone, as in U.S. Pat. Nos. 2,860,837; 3,150,839 and 3,843,068, which not infrequently fracture. The outer housing of the present frame can thus be made-up from the relatively light filler plates which serve merely to box the rib plates relative to the two flanges and to enclose the frame to keep out dust. The need for gussets between the two flanges and the outer housing, as in U.S. Pat. Nos. 2,860,837 and 3,150,839, is also eliminated.

All the parts are individually fabricated by the relatively simple operations of cutting or rolling and then welding. The inner main shaft housing is first welded up from individual rolled compartments which provide an exterior circumferential shoulder. The upper and lower flanges and the filler and rib plates are simply cut from flat stock, the inner ends of the rib plates being provided with complementary shoulders abutting that of the inner housing. The rib plates are then welded to the inner housing and to the opposed faces of the two flanges, after which the filler plates are welded in position. The drive shaft housing itself is a simple rolled tubular member welded in holes cut through the inner housing and one of the filler plates. All of the foregoing welding is readily accomplished on simple fixtures, after which the completed frame undergoes various machining and other finishing operations which also are easily accomplished without need of special or expensive jigs.

BRIEF DESCRIPTION OF THE DRAWINGS

FIG. 1 is an isometric view of the crusher frame of the present invention shown after its assembly but before machining and other finishing operations.

FIG. 2 is a top plan view of the frame of FIG. 1.

FIG. 3 is a sectional view taken along the line 3—3 of FIG. 2.

DETAILED DESCRIPTION OF THE PREFERRED EMBODIMENT

Beginning with the inner housing 10, which contains and supports the crusher main shaft, it will be observed from FIG. 3 that it is fabricated from a series of concentric annular or tubular sections 10*a*, 10*b*, 10*c* and 10*d*, all of which are formed by rolling and welding in well-known manner. The inner periphery of the top-most housing section 10*a* is greater in diameter than that of the axially longer section 10*b* just below it and that in turn greater than the diameter of the inner periphery of the lower-most sections 10*c* and 10*d* whose inner diameters are equal. The outer periphery of the housing section 10*a* is also greater than that of the section 10*b* just below it in order to form an overhanging shoulder 11. The sections 10*a*, *b*, *c* and *d* are all fixture welded up as indicated, their inner peripheries providing for an upper radial bearing seat 12, a thrust bearing seat 13, and a lower radial bearing seat 14. Then to the outer periphery of the inner housing 10 are fixture welded as indicated the inner ends of a number of vertical rib plates 20 cut from flat stock, their planes being radially disposed and parallel to the axis of the inner housing 10. The inner ends of the plates 20 are provided with upper set-backs to form shoulders 21 complementary to and abutting the inner housing shoulder 11. The radially inner portions 20*a* of the rib plates 20 are of generally trapezoidal shape so that they angle up beyond the level of the upper end of the inner housing 10. The radially outer end portions 20*b* of the rib plates 20 are rectangular in shape and their lower and upper edges are fixture welded as indicated to the axially opposed faces 22*a* and 23*a* of a lower base flange 22 and an upper bowl support flange 23 which spacedly encompass the inner housing 10. The outer periphery of the base flange 22 is preferably of polygonal shape, its apices coinciding with the outer ends 20*b* of the rib plates 20. The inner periphery of the base flange 22 and the inner and outer peripheries of the support flange 23, however, are preferably circular, both flanges 22 and 23 being cut from suitable flat stock.

In order to box the rib plates 20 and the flanges 22 and 23 and to form an outer housing or enclosure 24 concentric with the inner housing 10, the openings between the rib plates 20 are closed by filler plates 24*a*, also cut from plate stock and fixture welded in place as indicated. As shown in the drawings, each filler plate 24*a* is vertically bent at two locations 24*b* so that the outer housing 24 is essentially of polygonal cross-sectional shape with respect to the axis of the inner housing 10. Finally, a cylindrical drive shaft housing 25, in the form of a rolled and welded tube, is inserted through holes cut in the inner housing sections 10*a* and 10*b* and in one of the filler plates 24*a'* between a pair of adjacent rib plates 20, the axis of the drive shaft housing 25 being disposed radially with respect to that of the housing 10. The housing 25 is welded in place to the housing 10, the flange face 22*a* and the filler plate 24*a'* as indicated. A gusset plate 26 is then welded to the top of the housing 25 and to the inner housing section 10*a* and the filler plate 24*a'*. The frame can thereafter be readily machined and finished where necessary.

Note how the complementary shoulders 11 and 21 between the inner housing 10 and the rib plates 20 resist crushing loads in the direction of the axis of the housing 10 between, first, the housing 10 imposed by the crusher main shaft (not shown) and, second, the rib plates 20 imposed by the crusher bowl (not shown) through its support flange 23, thus eliminating many of the shear stresses on the welds between the housing 10 and rib plates 20. At the same time, the fact that the rib plates 20 are carried through the outer housing 24 and welded to the opposed faces 22*a* and 23*a* of the base and support flanges 22 and 23 also results in the latter being supported directly by the rib plates 20 and not through the medium of welds, eliminating the proliferation of gussets and welds that so often characterize other composite crusher frames and often fracture. The outer housing 24, since it is relieved of primary crushing loads, needs serve only to box the rib plates 20 and flanges 22 and 23 and to close the openings between them against dust. There is hence constructed a crusher frame of great strength and rigidity from a few simple, economical components in straight forward steps.

Though the present invention has been described in terms of a particular embodiment, being the best mode known of carrying out the invention, it is not limited to that embodiment alone. Instead the following claims are to be read as encompassing all adaptations and modifications of the invention falling within its spirit and scope.

I claim:

1. A composite frame for cone crushers and the like fabricated from a plurality of frame members and secured by welds, the members comprising: a generally cylindrical inner housing having an axis and opposite first and second axial ends, the housing having a bore therethrough along said axis; a generally annular base flange disposed in spaced surrounding relation to the outer periphery of the inner housing adjacent said first end thereof; a generally annular bowl support flange disposed in spaced surrounding relation to the outer periphery of the inner housing adjacent said second end thereof, the base and support flanges having opposed axially facing end faces and being coaxial with the inner housing; a plurality of integral rib plates disposed in planes parallel to said axis, the inner ends of the rib plates being secured as aforesaid to the outer periphery of the inner housing at spaced locations thereabout, the rib plates extending radially therefrom to and between said end faces of the base and support flanges and secured thereto as aforesaid; a plurality of filler plates secured as aforesaid between the opposed faces of each adjacent pair of the rib plates and between said end faces of the base and support flanges effective to box the rib plates and the base and support flanges and to close over the opening therebetween; and a drive shaft housing extending through both the inner housing and the filler plates between a pair of the rib plates, the drive shaft housing being secured as aforesaid to the inner housing and the filler plates and having a bore therethrough radially disposed with respect to said axis.

2. The crusher frame of claim 1 wherein the outer periphery of the inner housing and the inner ends of the rib plates include complementary shoulders engaging each other effective to resist crushing loads imposed between the inner housing and the rib plates in the direction of said axis.

3. The crusher frame of claim 2 wherein the inner housing includes first, second and third annular housing sections, the first housing section being secured to the second housing section and forming said first end of the inner housing, the inner periphery of the first housing section having a lesser diameter than that of the inner periphery of the second housing section and providing for a lower radial bearing housing, the first housing section also having an axial end face facing said second end of the inner housing and providing for a thrust bearing seat, the third housing section being secured to the second housing section and forming said second end of the inner housing, the outer and inner peripheries of the third housing section having greater diameters than those of the second housing section, the outer peripheries of the second and third housing sections together providing said shoulder on the inner housing, the inner peripheries of the second and third housing sections together providing for an upper radial bearing housing, the inner radial ends of the rib plates abutting the outer peripheries of the second and third housing sections with said rib plate shoulders in engagement with said inner housing shoulder.

4. The crusher frame of claim 3 wherein the support flange is disposed axially beyond said second end of the inner housing, and the base flange is disposed axially between said first and second ends of the inner housing.

5. The crusher frame of claim 4 wherein the outer periphery of the drive shaft housing extends through the second housing section and one of the filler plates, the drive shaft housing being secured as aforesaid to the second and third housing section, said filler plate and said end face of the base flange.

* * * * *